United States Patent [19]

Tully

[11] 4,137,679

[45] Feb. 6, 1979

[54] INVERTED, DOUBLY-CURVED UMBRELLA, HYPERBOLIC PARABOLOID SHELLS WITH STRUCTURALLY INTEGRATED UPPER DIAPHRAGM

[76] Inventor: Daniel F. Tully, 110 Ellis Farm La., Melrose, Mass. 02176

[21] Appl. No.: 812,513

[22] Filed: Jul. 5, 1977

[51] Int. Cl.[2] ..... E04B 1/34; E04B 7/10

[52] U.S. Cl. ..... 52/73; 52/80; 52/263; 52/236.3

[58] Field of Search ..... 52/73, 80, 236.3, 263

[56] References Cited

U.S. PATENT DOCUMENTS

| | | | |
|---|---|---|---|
| 2,419,843 | 4/1947 | Marten | 52/73 X |
| 3,195,274 | 7/1965 | Itoh | 52/73 |
| 3,719,012 | 3/1973 | Laurent | 52/73 |

FOREIGN PATENT DOCUMENTS

| | | | |
|---|---|---|---|
| 870169 | 3/1953 | Fed. Rep. of Germany | 52/73 |
| 2452927 | 5/1976 | Fed. Rep. of Germany | 52/73 |
| 455590 | 3/1950 | Italy | 52/73 |

*Primary Examiner*—J. Karl Bell
*Attorney, Agent, or Firm*—Joseph Zallen

[57] ABSTRACT

A building unit which comprises a column adapted to be fitted to a foundation and supporting a plurality of identical, doubly-curved umbrella, hyperbolic paraboloid shells inverted so that their top edges form a plane figure, and a continuous, horizontal member integrated with said edges.

4 Claims, 8 Drawing Figures

INVERTED, DOUBLY-CURVED UMBRELLA, HYPERBOLIC PARABOLOID SHEELS WITH STRUCTURALLY INTEGRATED UPPER DIAPHRAGM

BACKGROUND OF INVENTION

This invention relates to structures utilizing hyperbolic paraboloid shells, and in particular, inverted, doubly-curved, umbrella hyperbolic paraboloid shells.

Such shells have been useful in the construction of roofs. Hyperbolic paraboloid roofs have aesthetic, structural and economic advantages for many purposes, as for example, inexpensive, attractive, large area structures free of intermediate columns, as for example, hangers, auditoriums and gymnasiums. It is believed that the most pertinent prior art on this subject is found in United States Patent Office Class 52, Subclass 80.

Prior to the present invention, roofs constructed from hyperbolic paraboloid shells could not be used for any other purpose since a depth of approximately 20 percent of the span was required for the roof structure to become economical and efficient. Thus, no working surface was provided on the roof.

On object of the present invention is to provide a novel, inverted, doubly-curved, umbrella hyperbolic paraboloid shell structure which has an efficient load-carrying capacity.

Other objects and advantages of this invention will be apparent from the description and claims which follow taken together with the appended drawings.

SUMMARY OF INVENTION

The invention comprises the structural integration of a thin, upper, horizontal diaphragm with the edges of a plurality of inverted, doubly-curved, umbrella, hyperbolic paraboloid shells. This is accomplished by providing a support column adapted to be anchored to a foundation, a plurality of identical, inverted, doubly-curved, umbrella, hyperbolic paraboloid shells whose edges form a plane figure, and a thin, horizontal, upper slab integrated with the edges of the plane figure so as to form a diaphragm which provides both a working, horizontal surface, such as in a floor, and also mathematically cancels the shearing forces of the shells. Customary edge member tensile reinforcements are not required. The forces are transferred from the inclined shell into the horizontal surface enabling significantly larger spans than have been heretofore feasible and also providing for multi-story structures.

The structures of this invention are preferably made from cementitous material using reinforced concrete technology. However, certain advantages exist in the use of other materials of construction, such as steel sheets or glass fiber reinforced resins. These materials would utilize the horizontal diaphragm primarily for the significant stiffness it imparts to a system where very great spans are desired, and in such case the horizontal working surface may be a secondary benefit of the system rather than co-primary benefit.

In one form of the invention a plurality, such as four, identical, inverted, doubly-curved, umbrella, hyperbolic paraboloid shells are formed attached to a central support column so that their top edges form a rectangle. Integral with these top edges is a continuous, horizontal roof member. Between the shells and the roof member are secondary supports, as for example, secondary column structures comprising vertical columns and horizontal beams. Reinforcing rods and mesh are used with appropriate forms to first cast the column, then the shells and finally the upper slab.

Where multi-story structures are to be devised, a column of full height is first formed and then the erection of the form on the top of the column, which is supported by cables also, so that the top shells are formed first, and the form lowered to the next lower floor lever for pouring those shells.

A single unit of this invention can have a span in the range of from 20 to 200 feet. Where multiple units are used integrated together, a huge top surface, as for example equivalent to three football fields, can be provided as a continuous horizontal, supporting surface.

SPECIFIC EXAMPLE OF INVENTION

Figure 1:
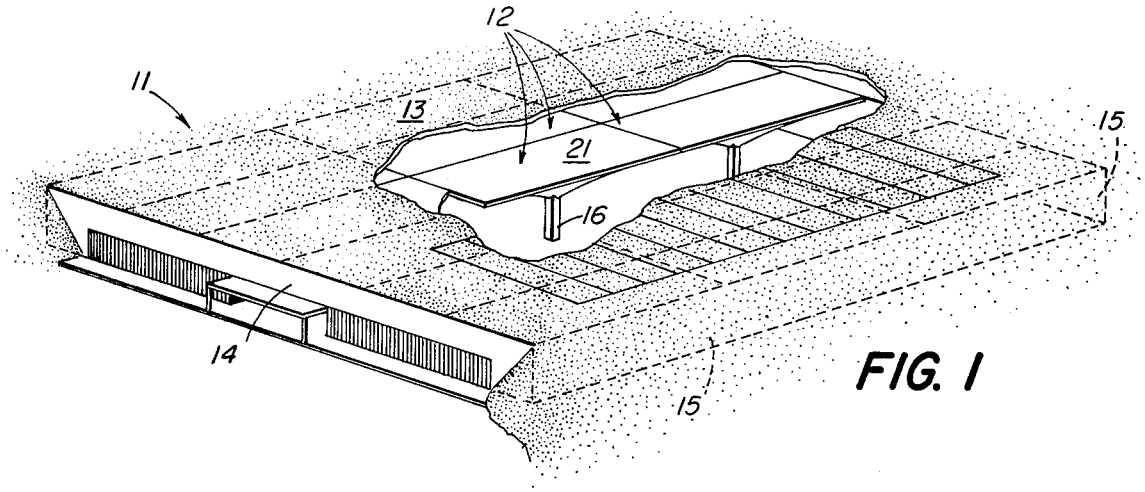
FIG. 1 is a schematic, perspective view with partial cutaway of an underground building made up of a large plurality of the basic units of this invention.
Figure 2:
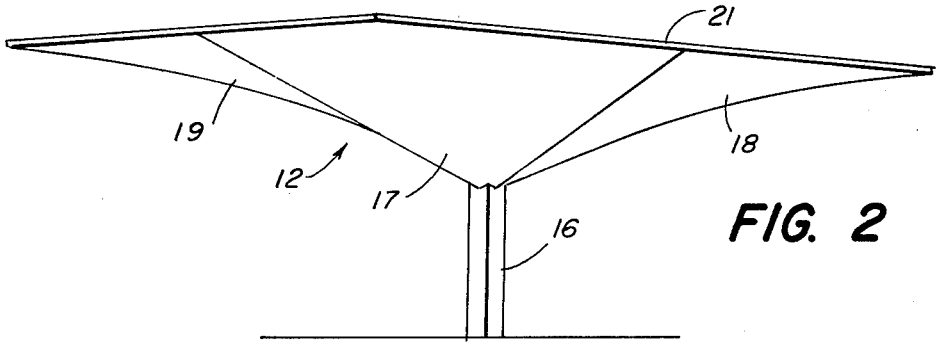
FIG. 2 is a perspective view of the basic unit of this invention.
Figure 3:
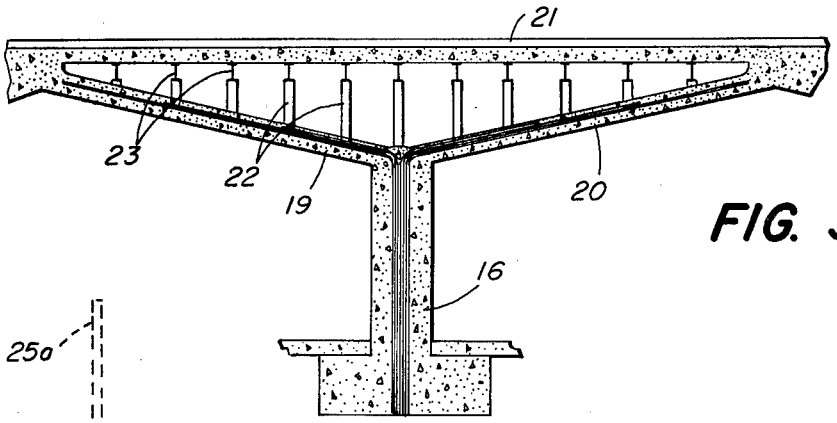
FIG. 3 is a transverse section of the basic unit of this invention integrated with adjacent units.
Figure 5:
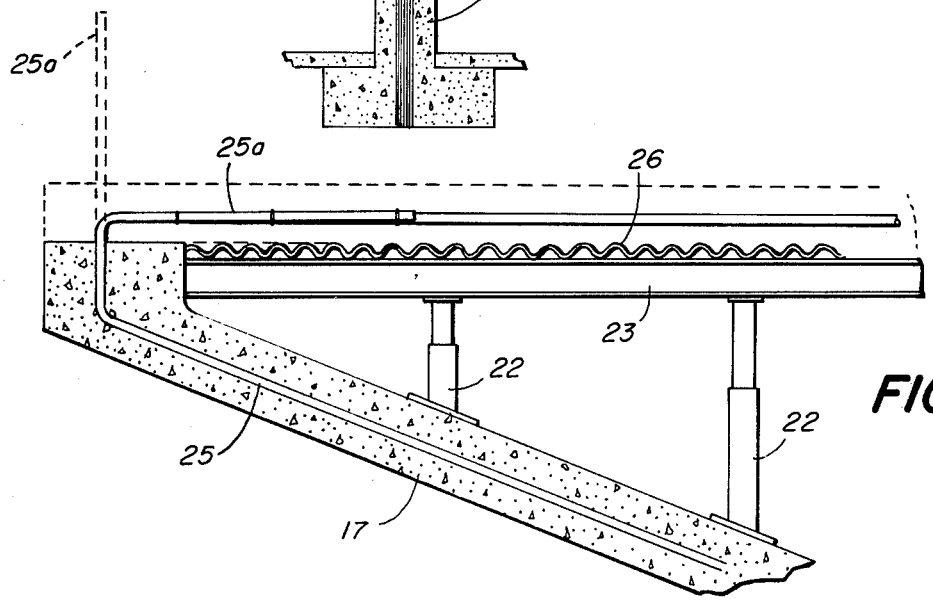
FIG. 5 is an enlarged, partial cross section with cutaway of the basic unit of this invention showing the steel reinforcement and the secondary columns.

An underground building situated in the side of a hill is illustrated in FIG. 1 and shows a sod surface on the huge roof of the building. The layout of a football field is shown. The building is made by integrating a large number of basic units of the present invention.

The basic units 12 of this invention each have a support column 16, inverted, doubly-curved, umbrella, hyperbolic paraboloid shells 17, 18, 19 and 20 whose top edges form a rectangle across which a horizontal slab 21 is integrated acting as a diaphragm. Building 11 illustrated in FIG. 1 shows the integration of eighteen such units to form the building which is finished by adding front wall 14 and side walls 15.

Horizontal roof slab member 21, being a thin, horizontal diaphragm, interacts with the hyperbolic shells 17 to 21 so that the horizontal surface 21 has an equal or opposite reaction mathematically to the shearing forces. The diaphragm roof member 21 thus provides a working, supportive, horizontal surface with large spans. The unit of this invention utilizes secondary support columns 22 which extend between the surface of the hyperbolic paraboloid segment to the diaphragm roof 21. These secondary columns 22 engage the diaphragm roof 21 through transversely extending I-beams 23.

Figure 4:
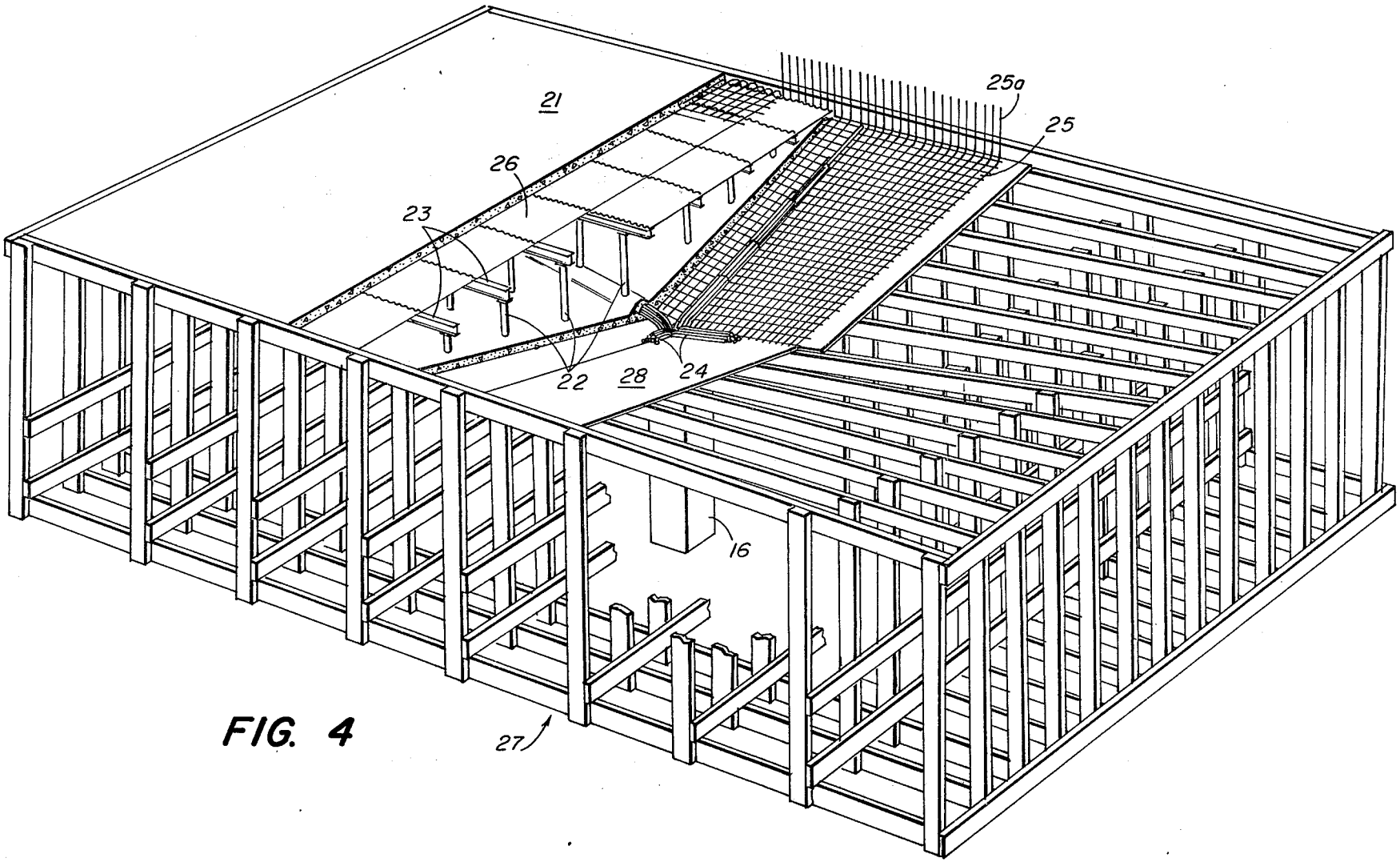
FIG. 4 is a perspective view with partial cutaway of several layers of forms and reinforcement materials usable in the construction of a unit of this invention.

Conventional reinforced concrete technology can be used in a construction of buildings utilizing the novel units of this invention. FIG. 4 illustrates the construction of a single unit, a supporting wooden framework 27 utilizing rods 24 and mesh 25 for its reinforcing members.

The forms include wooden forms 28 for the hyperbolic paraboloid sections which can be removed with the supporting framework 27 after the concrete has set. The forms 26 for the diaphragm roof 21 are placed on the I-beams 23 or equivalent members and can be corrugated metal. These forms are left in place after the roof member 21 has been poured and set.

Figure 6:
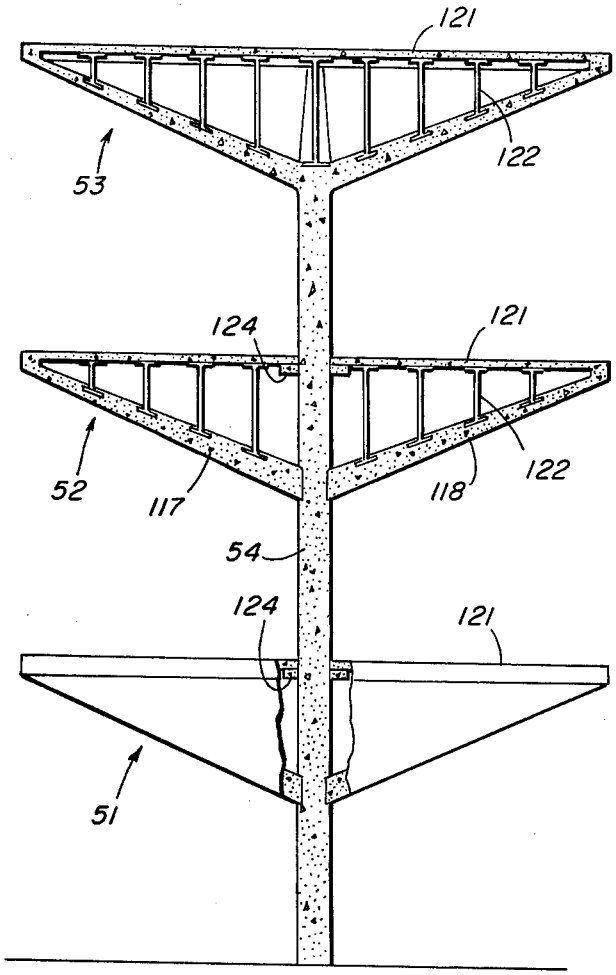
FIG. 6 is an illustration with a partial cutaway of a portion of a three-story structure employing the basic unit of this invention.
Figure 7:
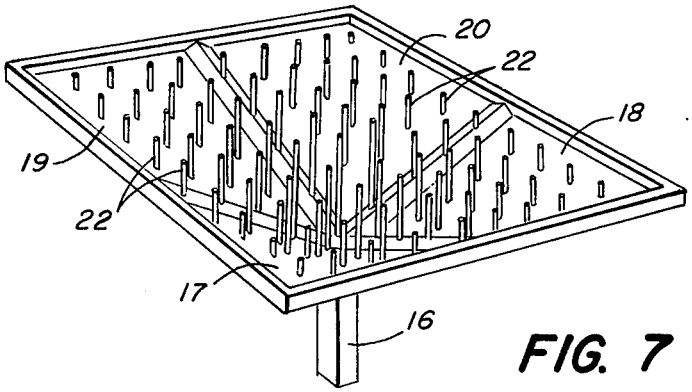
FIG. 7 is a perspective view with the top diaphragm removed showing secondary columns which can be used to support the top diaphragm where there are very large spans.
Figure 8:
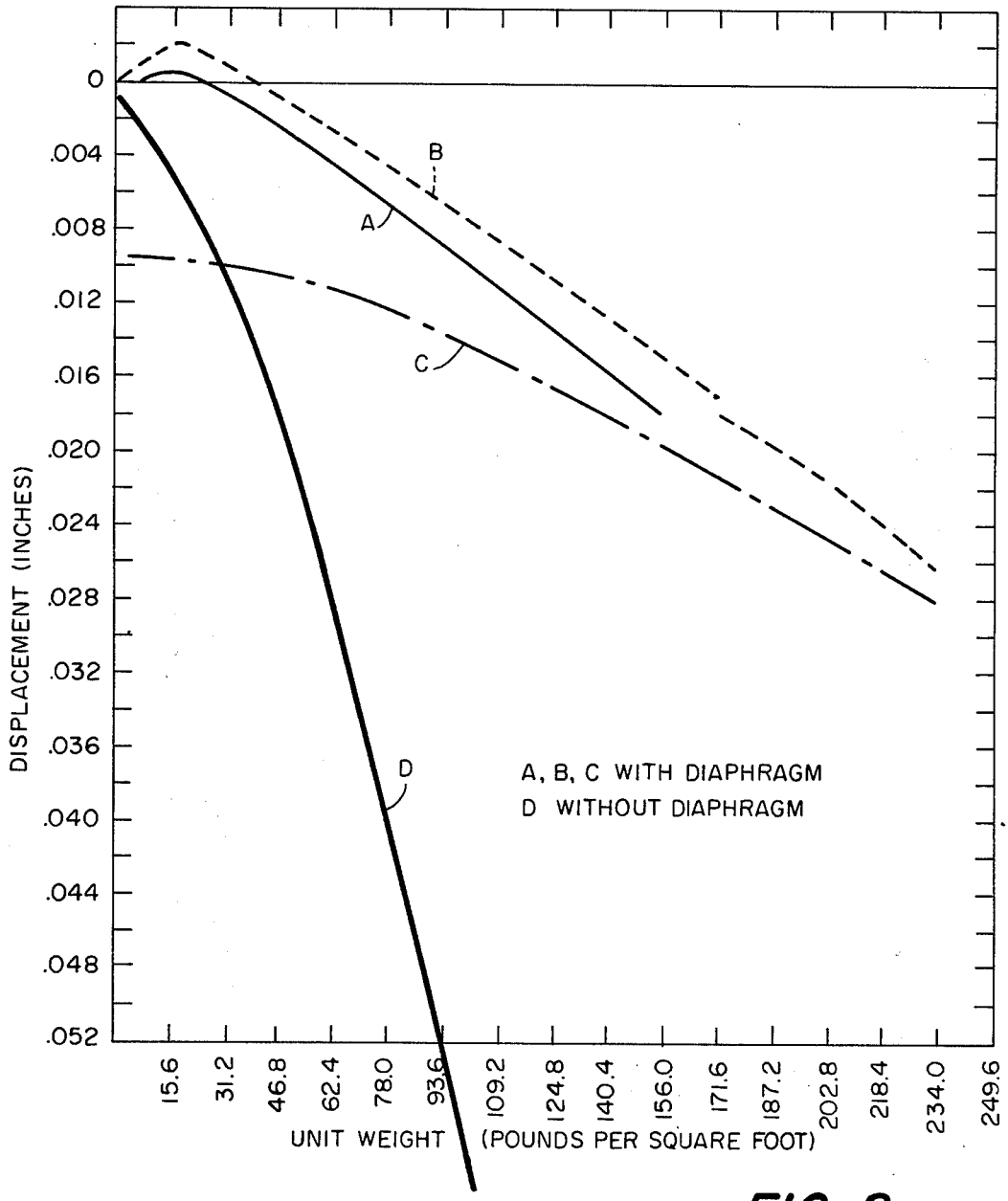
FIG. 8 is a graph of actual load tests and deflection results of a microconcrete, precise scale, structural model. This graph plots the significantly reduced deflections and thus the significantly greater rigidity or strength of this invention when compared to a conventional inverted, hyperbolic paraboloid umbrella without a structurally integrated diaphragm.

In addition to the type of building illustrated in FIG. 1, where all of the novel units 12 of this invention are positioned in substantially one horizontal plane, multiple roofs can be constructed, as illustrated in FIG. 6 with three ascending units 51, 52 and 53 on a common column 54. This sort of construction permits multiple level buildings of exceptional strength.

At the top of the common column, the inverted shells with secondary columns 122 support the upper, horizontal slab or diaphragm 121 similar to the preceding embodiment of this invention. In the lower and intermediate members 51 and 53, the hyperbolic shells 117 and 118 are formed around the central column 54 as are the upper diaphragms 121. For improved strength a flange 124 may be provided to give support to the diaphragm near the center.

I claim:

1. A building unit comprising a column adapted to be anchored to a foundation and supporting a plurality of doubly-curved, umbrella, hyperbolic paraboloid shells inverted so that their top edges form a plane figure and a continuous horizontal member integrated with said edges.

2. The building unit of claim 1 wherein there are secondary supports between said hyperbolic shells and said horizontal member.

3. The building unit of claim 1 made of cementitious material and having stiffening structures extending between the hyperbolic paraboloid sections and horizontal member comprising vertical columns and horizontal beams.

4. The building unit of claim 1 made of elements selected from the class consisting of steel elements and glass fiber reinforced resin and having stiffening structures extending between the hyperbolic paraboloid sections and horizontal member comprising vertical columns and horizontal beams.

* * * * *